United States Patent [19]

Baynes et al.

[11] 3,936,208

[45] Feb. 3, 1976

[54] REFLECTOR STUD

[75] Inventors: Frederick Baynes, Bowden; James Munro Lawrie, Bolton, both of England

[73] Assignee: Dunlop Limited, London, England

[22] Filed: Mar. 28, 1974

[21] Appl. No.: 455,905

[30] Foreign Application Priority Data

Apr. 3, 1973 United Kingdom ..... 15872/73

[52] U.S. Cl. ..... 404/16

[51] Int. Cl.[2] ..... G08G 1/00

[58] Field of Search ..... 404/16, 15, 9, 10; 116/63

[56] References Cited

UNITED STATES PATENTS

| | | | |
|---|---|---|---|
| 2,005,170 | 6/1935 | Segelhorst | 404/16 |
| 2,065,314 | 12/1936 | Johnson | 404/16 |
| 2,229,179 | 1/1941 | Langdon | 404/16 |
| 3,516,337 | 6/1970 | Gubela | 404/16 X |
| 3,693,511 | 9/1972 | Mieczyslaw | 404/16 X |
| 3,758,191 | 7/1973 | Hedgewick | 404/16 |

*Primary Examiner*—Nile C. Byers

*Attorney, Agent, or Firm*—Stevens, Davis, Miller & Mosher

[57] ABSTRACT

A road marker stud of cat's eye is made of a rubber housing and is to be adhered to the road surface. The housing is provided with surface channels or cavities which divide it into substantially independent flex zones.

At least one reflector element is housed in a side face of the housing, the side face extending parallel to one of the channels or cavities. The stresses of impacting wheels are thereby better accommodated.

9 Claims, 9 Drawing Figures

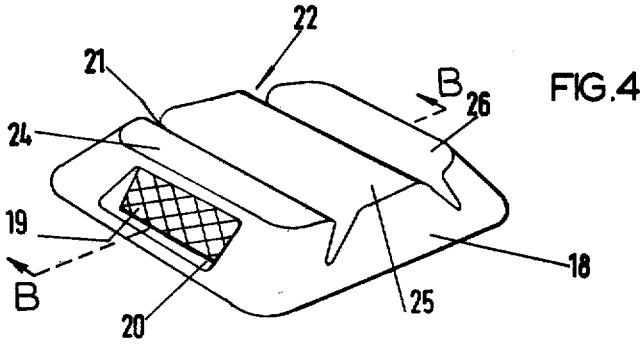
FIG.4
FIG.5
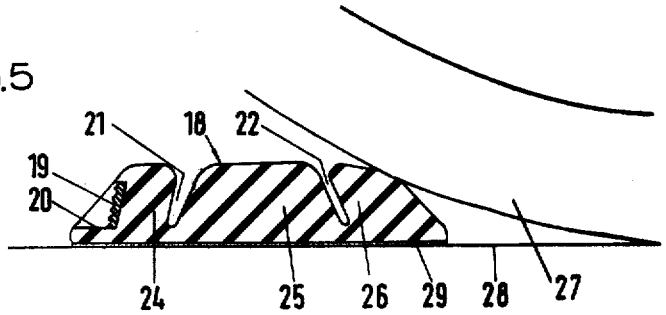
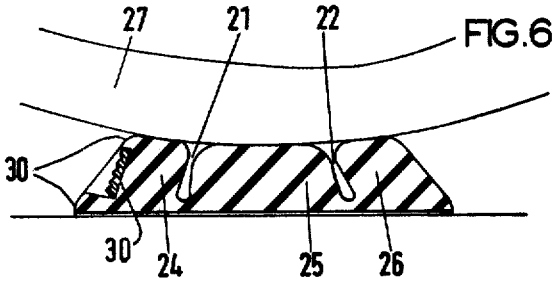
FIG.6

REFLECTOR STUD

This invention relates to reflector studs. It is particularly concerned with housings for reflective devices and especially to reflective road marker studs such as may be used to indicate traffic lanes. Thus the invention is particularly concerned with a road marker stud adapted to accommodate static and dynamic pressures imposed by vehicle wheels without detriment to its reflective ability.

Prior art road studs or "cats eyes" comprising a heavy metal base and rubber and other components, are well known and have been in use for many years. They are, however, expensive, complex units which have to be installed in cavities cut into a road surface. It would, therefore, clearly be advantageous to provide a less complex unit which can be simply adhered to a road surface.

For several reasons, elastomeric materials (rubber) may be considered suitable for the manufacture of such adhesively-attached road studs. Such material can be formed relatively easily. It can be formulated to provide impact-and abrasion-resistance and it has inherent, shape-restoring ability. Rubber is, however, virtually incompressible and this factor places serious limitations on its use.

By way of example, a simple tile-like element of solid, vulcanized rubber composition and having relatively inflexible reflectors housed in or adhesively-attached to one or more faces may be considered appropriate for use as a road-marking stud. However, a stud of this type would probably fail to provide continued reflection under conditions of continuous deflection and recovery.

In very general terms, although rubber is incompressible it is frequently easily deformable. Thus, under load, the volume of a rubber unit will remain practically constant while its shape may be significantly altered. On removal of the load, the rubber unit will return in its original shape. In the case of a road stud of the type discussed in the preceding paragraph, deflection and recovery would have at least two adverse effects:

1. Stresses would be transmitted to the stud/road interface, leading to eventual failure of the bond and separation of the stud from the road surface.
2. Stresses would similarly be transmitted to the reflector housing or interface, this leading to eventual separation of the relatively rigid reflector from the housing.

The present invention aims to overcome the difficulties by elastomeric road stud housing adapted to accommodate deformation or displacement under load without loss of bond strength to a road surface and without ejection of a reflector. This can be achieved by introducing discontinuity in the mass of a road stud/-housing, i.e. the rubber matrix, said discontinuity serving to divide the housing into zones.

Accordingly the invention provides a reflector stud to be adhered to a road or other surface, comprising a housing of elastomeric material divided, by means of channels in its surface or cavities extending within its body, into zones which can flex or deform substantially independently of each other, the housing having at least one side face extending substantially parallel to one of said channels or cavities and containing a location for a reflector element. Such provision permits the flexure of individual zones thus reducing stress accumulation and modifying the angle of impact of say a wheel, so as to reduce the intensity of impact forces. Thus, for example, the rubber body of the housing can be moulded, or otherwise produced, with cut-out areas or cavities in the faces or in the body of the housing. In one embodiment, therefore, the resilient body of the housing is provided with channels in one or more faces. The channels are preferably in the face opposite to that to be in contact with the road. As indicated above, in another embodiment, the discontinuities may be within the body of the housing in the form of cavities. The cavities may be completely or partially emclosed. If desired a combination of facial channels and body cavities may be used.

The reflector portion of the housing may be any conventionally-used reflector and may be incorporated in the housing by known techniques. It may for example be adhered in a suitable recess and/or mechanically held in a lipped recess.

The housing preferably has two substantially parallel main surfaces, one of which is to be adhered to the road and the other, i.e. upper surface may contain the channels. Such an arrangement is not essential, however, and the upper surface may, for example, have a curved aspect.

The invention is further illustrated with reference to the accompanying drawings in which:

FIG. 4 is a perspective view of one form of road stud of the present invention;

FIG. 5 is a section along line BB of FIG. 4 and showing the initial impact of an impingeing wheel;

FIG. 6 is a similar view to FIG. 5 but showing the wheel impact at a later stage;

Figure 1:
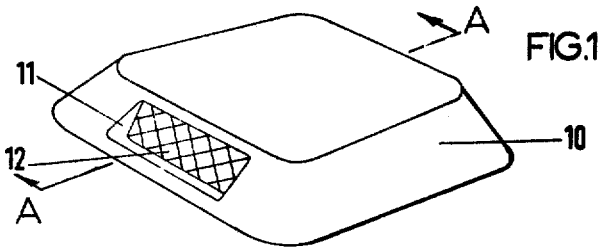
FIG. 1 is a perspective view of a known type of solid rubber road stud.

The stud of FIG. 1 comprises a rubber housing 10 having in one outer surface (side surface) a recess 11 containing a reflector element 12. The reflector element may conveniently comprise a strip of relatively rigid material containing glass prisms or other reflective media.

Figure 2:
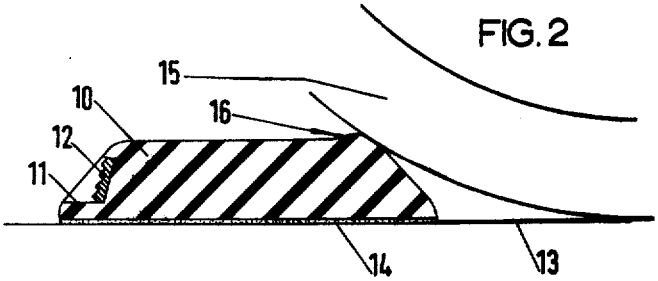
FIG. 2 is a section along line AA of FIG. 1 and showing the initial impact of an impingeing wheel.

This stud is shown in section in FIG. 2 where it is shown attached to a road surface 13 by means of an adhesive layer 14. An impingeing vehicle wheel is shown at 15. Under the pressure exerted by the vehicle wheel, deformation of the stud occurs and this is realized as a wave, or bulge in advance of the contact area. This wave effect is indicated at 16. As deformation continues, the stresses accumulate within the stud.

Figure 3:
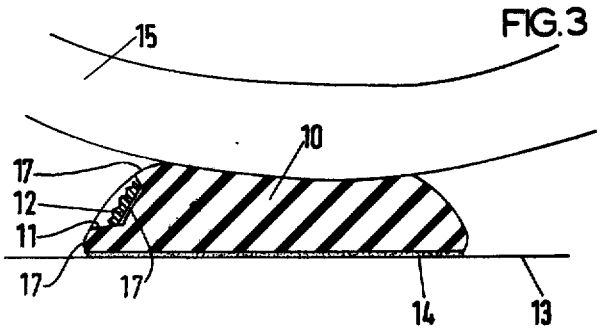
FIG. 3 is a similar view to FIG. 2 but showing the wheel impact at a later stage.

FIG. 3 illustrates, in exaggerated form, the effect of the stress accumulation at a latter stage. It will be noted that the reflector recess 11 and the adjacent surface 17 have assumed a curved configuration. It will be apparent that the ability of the recess to retain the reflector 12, whether by adhesive or other means, is considerably reduced as a result of the induced curvature. The effect of deformation on the bond between stud and road is also shown in the drawing where the curvature creates stresses at the external bond line.

FIG. 4 is a perspective view of a road stud according to the present invention. The stud comprises a rubber housing 18 and a reflector element 19 in a recess 20. Housing 18 is however provided with transverse channels 21 and 22 in its upper surface which substantially divide the housing into three zones 24, 25 and 26.

In FIGS. 5 and 6 the stud of FIG. 4 is shown in section and adhered to a road surface. FIG. 5 shows the early stage when the stud is under pressure exerted by an impingeing vehicle wheel 27. The sutd is adhered to a road surface 28 by an adhesive layer 29. Zone 26 of the stud is deformed as a result of the applied pressure, causing a narrowing of the channel 22. The stresses are substantially contained within Zone 22 and do not accumulate within the mass of the housing.

FIG. 6 shows the section of the stud at a later stage where Zones 24, 25 and 26 are all under load from wheel 27. This results in the narrowing of channels 21 and 22, but causes substantially no deformation of the reflector-containing surface 30. The discontinuity caused by the transverse channels has reduced the stress accumulation to a negligible level, and so modified the angle of impact of a vehicle wheel as to cause little or no deformation to the reflector-containing surface and the stud/road interface.

(It will be apparent that a road stud of the present invention may contain more than one reflective element. Commonly a road stud will have two such elements, contained on opposite faces. For such usage a housing of the type shown in FIG. 4 will be suitable.)

Figure 7:
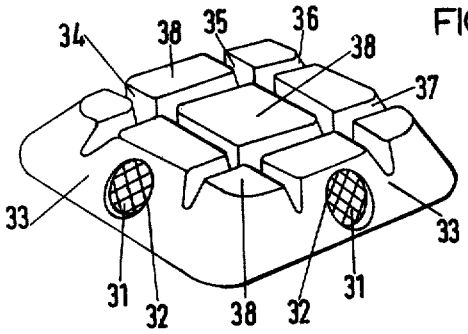
FIG. 7 is a perspective view of another form of road stud of the present invention.

FIG. 7 is a perspective view of another form of road stud of the invention. This road stud has four circular reflective elements 31 (two of which are shown), each element being located in a recess 32 one recess being in each of side faces 33 of the stud. The stud has two pairs of parallel intersecting channels 34, 35 and 36, 37 in its upper surface. Each channel intersects both of the channels of the other pair at right-angles, thereby providing nine independent stress zones 38.

Figure 8:
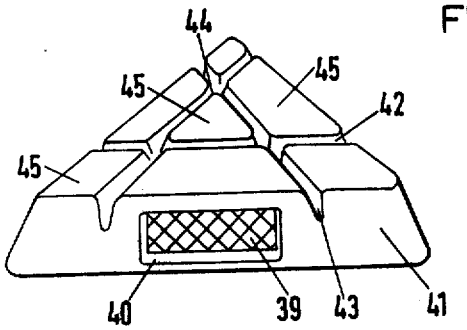
FIG. 8 is a perspective view of yet another form of road stud of the present invention.

FIG. 8 shows a further modified stud of the invention having a triangular planshape. It has three reflective elements 39 (one of which is shown) of rectangular shape. Each element is located in a suitable recess 40 in each side face 41 of the stud housing. Three channels 42, 43 and 44 extend across the upper surface of the stud, one channel being parallel to each side face. The channels intersect to provide seven independent stress zones 45.

In the case of both studs (of FIGS. 7 and 8) stress accumulation is avoided and the impact angle caused by impacting wheels is modified by the provision of stress-interrupting channels which serve to divide the stud housing into substantially separate zones. (Clearly the provision of circular or rectangular or other shaped reflective elements is a matter of choice and those of FIGS. 7 and 8 for example could be exchanged or even mixed.)

Figure 9:
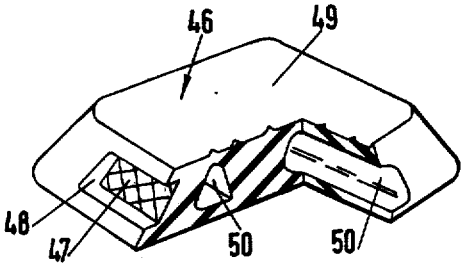
FIG. 9 is a perspective view with parts cut away of a further form of road stud of the present invention.

As indicated above, it may be preferable to provide a stud having an uninterrupted upper surface. In such cases, zone-defining channels may be provided in the body of a stud housing. Such an arrangement is shown in FIG. 9. This stud comprises a rubber housing 46 of the same general shape as that of FIG. 1. The housing has a rectangular reflector element 47 in a recess 48 in one of its faces. The upper surface 49 of the housing is smooth and uninterrupted. The zone-defining discontinuities are in the form of continuous cavities 50 extending through the body of the road stud housing.

In all of the embodiments described above, the housing is preferably made from an elastomeric composition containing protective ingredients to impart resistance to abrasion, ageing, ozone and other destructive effects. Such compositions are well known in the art. The housings are preferably formed by an injection moulding process and are preferably unitary mouldings. The elastomeric composition may, for example, have a vulcanized hardness of about from 60° to 95° International Rubber Hardness Degrees (I.R.H.D.) preferably from 85° to 90° I.R.H.D. This hardness has been found by trials to be suitable for the application but it is obviously not a limiting factor — and may in fact be adjusted to meet differing conditions.

Having now described our invention what we claim is:

1. A unitary reflector stud housing of elastomeric material of a hardness from 60 to 95 I.R.H.D. and having a substantially flat under surface to be adhered to a road surface, channels in said housing in the surface opposite to said flat under surface dividing the housing into zones which can deform substantially independently of each other, said housing having at least one side face extending substantially parallel to one of said channels, said side face containing a location for a reflector element.

2. A reflector stud having according to claim 1, in which the surface which is to be adhered to the road surface is substantially parallel to the surface which contains said channels.

3. A reflector stud having according to claim 1, in which the location for the reflector element is a lipped recess.

4. A reflector stud having according to claim 1, which is formed from an elastomeric composition having a hardness of from 85 to 90 I.R.H.D.

5. A reflector stud comprising a housing which is of elastomeric material of a hardness of 60 to 95 I.R.H.D. and having a substantially flat under surface to be adhered to a road surface, said housing being divided by means of channels in said housing in the surface opposite to said flat under surface into zones which can deform substantially independently of each other, said housing having at least one side face extending substantially parallel to one of said channels, said side face containing a location for a reflector element, and a reflector element mounted therein.

6. A reflector stud according to claim 5, in which the surface which is to be adhered to the rod is substantially parallel to the surface which contains said channels.

7. A reflector stud according to claim 5, in which the location for the reflector element is a lipped recess.

8. A reflector stud according to claim 5, in which the housing is formed from an elastomeric composition having a hardness of from 85 to 90 I.R.H.D.

9. A reflector stud according to claim 5, in which the reflector element is a strip of rigid material containing reflective media.

* * * * *